US011974604B2

(12) United States Patent
Frederick et al.

(10) Patent No.: US 11,974,604 B2
(45) Date of Patent: May 7, 2024

(54) HEATER ASSEMBLY WITH PIERCED TRANSPORT MATERIAL

(71) Applicant: Philip Morris Products S.A., Neuchatel (CH)

(72) Inventors: Guillame Frederick, Neuchatel (CH); Patrick Charles Silvestrini, Neuchatel (CH); Jean-Marc Widmer, Neuchatel (CH); Ihar Nikolaevich Zinovik, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 756 days.

(21) Appl. No.: 17/057,918

(22) PCT Filed: May 29, 2019

(86) PCT No.: PCT/EP2019/064114
§ 371 (c)(1),
(2) Date: Nov. 23, 2020

(87) PCT Pub. No.: WO2019/229197
PCT Pub. Date: Dec. 5, 2019

(65) Prior Publication Data

US 2021/0204600 A1 Jul. 8, 2021

(30) Foreign Application Priority Data

May 31, 2018 (EP) ..... 18175387

(51) Int. Cl.
*A24F 47/00* (2020.01)
*A24F 40/44* (2020.01)
(Continued)

(52) U.S. Cl.
CPC ..... *A24F 40/46* (2020.01); *A24F 40/44* (2020.01); *A24F 40/485* (2020.01); *A24F 40/70* (2020.01); *A24F 40/10* (2020.01)

(58) Field of Classification Search
CPC ..... A24F 40/46; A24F 40/44; A24F 40/485
See application file for complete search history.

(56) References Cited

U.S. PATENT DOCUMENTS 11,628,263 B2 * 4/2023 Klurfeld ..... A61M 11/007 128/200.14
2015/0136156 A1 5/2015 Lin
(Continued)

FOREIGN PATENT DOCUMENTS

CN 102861694 A 1/2013
CN 105747278 A 7/2016
(Continued)

OTHER PUBLICATIONS

Combined Russian Office Action and Search Report dated Sep. 1, 2022 in Russian Patent Application No. 2020140823 (with English translation), 12 pages.
(Continued)

*Primary Examiner* — Neil Abrams
(74) *Attorney, Agent, or Firm* — Oblon, McClelland, Maier & Neustadt, L.L.P.

(57) ABSTRACT

A heater assembly for an aerosol-generating system is provided, including: a fluid-permeable heating element to vaporise a liquid aerosol-forming substrate; and a transport material to transport the substrate to the heating element and having a thickness defined between a first surface and an opposing second surface thereof, the first surface being in fluid communication with the element and the second surface being arranged to receive the substrate and provided with at least one hole extending into the material to a depth corresponding to at least a part of the thickness to define a
(Continued)

formed fluid channel for the substrate, the material including a capillary material having elongate fibres, an average direction of the fibres is substantially parallel to the first and second surfaces, and the hole extends substantially perpendicular to the average direction. A method of manufacturing a heater assembly, a cartridge, and an aerosol-generating system are also provided.

19 Claims, 5 Drawing Sheets

(51) Int. Cl.

| | |
|---|---|
| ***A24F 40/46*** | (2020.01) |
| ***A24F 40/485*** | (2020.01) |
| ***A24F 40/70*** | (2020.01) |
| *A24F 40/10* | (2020.01) |

(56) References Cited

U.S. PATENT DOCUMENTS

| | | | | |
|---|---|---|---|---|
| 2017/0215481 | A1 | 8/2017 | Li et al. | |
| 2017/0367402 | A1 | 12/2017 | Lau et al. | |
| 2018/0343922 | A1 | 12/2018 | Stadler et al. | |
| 2021/0204600 | A1* | 7/2021 | Frederick | A24F 40/485 |
| 2021/0235759 | A1* | 8/2021 | Courbat | A24F 40/46 |

FOREIGN PATENT DOCUMENTS

| | | | |
|---|---|---|---|
| CN | 105939625 | A | 9/2016 |
| CN | 107809921 | A | 3/2018 |
| JP | 3104182 | U | 9/2004 |
| JP | 2017-506509 | A | 3/2017 |
| RU | 2 646 557 | C2 | 3/2018 |
| RU | 2 657 215 | C2 | 6/2018 |
| WO | WO 2014/079024 | A1 | 5/2014 |
| WO | WO 2015/117702 | A1 | 8/2015 |
| WO | WO 2015/117703 | A1 | 8/2015 |
| WO | WO 2015/117704 | A1 | 8/2015 |
| WO | WO 2015/117705 | A2 | 8/2015 |
| WO | WO 2016/198417 | A1 | 12/2016 |
| WO | WO 2017/093535 | A1 | 6/2017 |
| WO | WO 2017/207320 | A1 | 12/2017 |
| WO | WO 2017/207322 | A1 | 12/2017 |
| WO | WO 2018/019477 | A1 | 2/2018 |
| WO | WO 2018/019486 | A1 | 2/2018 |
| WO | WO 2018/153608 | A1 | 8/2018 |

OTHER PUBLICATIONS

Office Action dated May 1, 2023 on the corresponding Japanese Patent Application No. 2020-562121 (with English Translation), 16 pages.

International Search Report and Written Opinion dated Sep. 10, 2019 in PCT/EP2019/064114 filed May 29, 2019.

Combined Chinese Office Action and Search Report dated Oct. 12, 2023 in Chinese Patent Application No. 201980030656.9 (with English Transiation), 9 pages.

* cited by examiner

HEATER ASSEMBLY WITH PIERCED TRANSPORT MATERIAL

The present invention relates to a heater assembly for an aerosol-generating system and a method of manufacturing a heater assembly for an aerosol-generating system. In particular, the invention relates to handheld aerosol-generating systems which vaporise a liquid aerosol-forming substrate by heating to generate an aerosol for inhalation by a user.

Handheld electrically operated aerosol-generating systems are known that consist of a device portion comprising a battery and control electronics, a cartridge portion comprising a supply of liquid aerosol-forming substrate held in a liquid storage portion, and an electrically operated heater assembly acting as a vaporiser. A cartridge comprising both a supply of aerosol-forming substrate held in the liquid storage portion and a vaporiser is sometimes referred to as a "cartomiser". The vaporiser typically comprises a coil of heater wire wound around an elongate wick soaked in liquid aerosol-forming substrate. Capillary material soaked in the aerosol-forming substrate supplies the liquid to the wick. The cartridge portion typically comprises not only the supply of liquid aerosol-forming substrate and an electrically operated heater assembly, but also a mouthpiece, through which a user may draw aerosol into their mouth.

It is generally desirable to ensure that a minimum amount of liquid aerosol-forming substrate is present in the capillary material to avoid a "dry heating" situation, i.e. a situation in which the fluid permeable heating element is heated with insufficient liquid aerosol-forming substrate being present. This situation is also known as a "dry puff" and can result in overheating and, potentially, thermal decomposition of the liquid aerosol-forming substrate, which can produce undesirable by-products such as formaldehyde.

According to a first aspect of the present application, there is provided a heater assembly for an aerosol-generating system, the heater assembly comprising: a fluid permeable heating element configured to vaporise a liquid aerosol-forming substrate, a transport material configured to transport liquid aerosol-forming substrate to the fluid permeable heating element, the transport material having a thickness defined between a first surface of the transport material and an opposing second surface of the transport material, wherein the first surface is arranged in fluid communication with the fluid permeable heating element and the second surface is arranged to receive liquid aerosol-forming substrate, wherein the second surface of the transport material is provided with at least one hole which extends into the transport material to a depth corresponding to at least a part of the thickness of the transport material to define a formed fluid channel for liquid aerosol-forming substrate.

During manufacture, the transport material is placed in fluid communication with the fluid permeable heating element. The transport material may be located within a housing or heater mount, which can comprise a part of the cartridge portion, and typically comprises a porous or fluid permeable material having a network of small pores or micro-channels through which liquid aerosol-forming substrate is transported or permeates. The dimensions of the transport material are generally slightly larger than the internal dimensions of the heater mount in order to provide a tight fit between the heater mount and the transport material, which helps to reduce the likelihood of leaks around the edges of the transport material. As a result, during insertion, the transport material is compressed orthogonal to the thickness direction of the transport material and towards the centre of the transport material, which may cause a closure or at least a decrease in the size of a proportion of the pores or micro-channels of the transport material. Consequently, transport of liquid aerosol-forming substrate through the transport material may be interrupted or reduced, which may result in insufficient liquid aerosol-forming substrate being present at the fluid permeable heating element and a dry puff.

In the first aspect of the invention described above, at least one hole is provided in the transport material which defines a formed fluid channel for liquid aerosol-forming substrate. The at least one hole remains open even when the transport material is compressed when it inserted into the housing such that liquid aerosol-forming substrate can freely enter the hole. The at least one hole extends into the transport material to a depth corresponding to at least a part of the thickness of the material such that the thickness of the transport material, and hence the resistance to fluid flow, is reduced in the region of the hole. This assists liquid aerosol-forming substrate to reach the fluid permeable heating element and reduces the likelihood of a dry puff and formaldehyde production. The applicant has found that the claimed arrangement can result in a 90% reduction in formaldehyde production compared to heater assemblies which do not have a hole provided in the transport material.

As used herein, the term "formed fluid channel" refers to a fluid channel which is provided in the transport material, i.e. the at least one hole, and is distinct from the pores or micro-channels belonging to the transport material by virtue of its porous or fluid permeable properties. In other words, the formed fluid channel is distinct from the pores or micro-channels which are intrinsic to the transport material. Furthermore, the formed fluid channel does not need to pass through the entire thickness of the transport material. The formed fluid channel only needs to extend sufficiently such that liquid aerosol-forming substrate can enter the channel.

The transport material may be in contact with the fluid permeable heating element. This helps transport liquid aerosol-forming substrate from the transport material to the heating element. Alternatively, there may be an intervening layer between the transport material and the fluid permeable heating element, with the intervening layer assisting in providing fluid communication between the transport material and the fluid permeable heating element.

The fluid permeable heating element may be substantially flat and may comprise electrically conductive filaments. This avoids the need for the winding of a heater wire coil around a capillary wick. The electrically conductive filaments may lie in a single plane. A planar heating element can be easily handled during manufacture and provides for a robust construction. In other embodiments, the substantially flat heating element may be curved along one or more dimensions, for example forming a dome shape or bridge shape.

The electrically conductive filaments may define interstices between the filaments and the interstices may have a width of between 10 μm and 100 μm. The filaments may give rise to capillary action in the interstices, so that in use, liquid to be vapourised is drawn into the interstices, increasing the contact area between the heating element and the liquid.

The electrically conductive filaments may form a mesh of size between 160 and 600 mesh US (+1-10%) (i.e. between 160 and 600 filaments per inch (+1-10%)). The width of the interstices is preferably between 75 μm and 25 μm. The percentage of open area of the mesh, which is the ratio of the area of the interstices to the total area of the mesh is preferably between 25 and 56%. The mesh may be formed using different types of weave or lattice structures. Alternatively, the electrically conductive filaments consist of an array of filaments arranged parallel to one another.

The electrically conductive filaments may have a diameter of between 10 μm and 100 μm, preferably between 8 μm and 50 μm, and more preferably between 8 μm and 39 μm. The filaments may have a round cross section or may have a flattened cross-section. The heater filaments may be formed by etching a sheet material, such as a foil. This may be particularly advantageous when the heater assembly comprises an array of parallel filaments. If the heater assembly comprises a mesh or fabric of filaments, the filaments may be individually formed and knitted together.

The area of the fluid permeable heating element may be small, for example less than or equal to 50 square millimetres, preferably less than or equal to 25 square millimetres, more preferably approximately 15 square millimetres. The size is chosen such to incorporate the heating element into a handheld system. Sizing of the heating element to be less or equal than 50 square millimetres reduces the amount of total power required to heat the heating element while still ensuring sufficient contact of the heating element to the liquid aerosol-forming substrate. The heating element may, for example, be rectangular and have a length between 2 millimetres to 10 millimetres and a width between 2 millimetres and 10 millimetres. Preferably, the mesh has dimensions of approximately 5 millimetres by 3 millimetres.

The filaments of the heating element may be formed from any material with suitable electrical properties. Suitable materials include but are not limited to: semiconductors such as doped ceramics, electrically "conductive" ceramics (such as, for example, molybdenum disilicide), carbon, graphite, metals, metal alloys and composite materials made of a ceramic material and a metallic material. Such composite materials may comprise doped or undoped ceramics. Examples of suitable doped ceramics include doped silicon carbides. Examples of suitable metals include titanium, zirconium, tantalum and metals from the platinum group.

Examples of suitable metal alloys include stainless steel, constantan, nickel-, cobalt-, chromium-, aluminum-, titanium-, zirconium-, hafnium-, niobium-, molybdenum-, tantalum-, tungsten-, tin-, gallium-, manganese- and iron-containing alloys, and super-alloys based on nickel, iron, cobalt, stainless steel, Timetal®, iron-aluminum based alloys and ironmanganese-aluminum based alloys. Timetal® is a registered trade mark of Titanium Metals Corporation. The filaments may be coated with one or more insulators. Preferred materials for the electrically conductive filaments are stainless steel and graphite, more preferably 300 series stainless steel like AISI 304, 316, 304L, 316L. Additionally, the electrically conductive heating element may comprise combinations of the above materials. A combination of materials may be used to improve the control of the resistance of the fluid permeable heating element. For example, materials with a high intrinsic resistance may be combined with materials with a low intrinsic resistance. This may be advantageous if one of the materials is more beneficial from other perspectives, for example price, machinability or other physical and chemical parameters. Advantageously, a substantially flat filament arrangement with increased resistance reduces parasitic losses. Advantageously, high resistivity heaters allow more efficient use of battery energy.

Preferably, the filaments are made of wire. More preferably, the wire is made of metal, most preferably made of stainless steel.

The electrical resistance of the mesh, array or fabric of electrically conductive filaments of the heating element may be between 0.3 Ohms and 4 Ohms. Preferably, the electrical resistance is equal or greater than 0.5 Ohms. More preferably, the electrical resistance of the mesh, array or fabric of electrically conductive filaments is between 0.6 Ohms and 0.8 Ohms, and most preferably about 0.68 Ohms. The electrical resistance of the mesh, array or fabric of electrically conductive filaments is preferably at least an order of magnitude, and more preferably at least two orders of magnitude, greater than the electrical resistance of electrically conductive contact areas. This ensures that the heat generated by passing current through the heating element is localized to the mesh or array of electrically conductive filaments. It is advantageous to have a low overall resistance for the heating element if the system is powered by a battery. A low resistance, high current system allows for the delivery of high power to the heating element. This allows the heating element to heat the electrically conductive filaments to a desired temperature quickly.

The depth of the at least one hole may be more than half of the thickness of the transport material. This means that the liquid aerosol-forming substrate has to pass through less than half of the thickness of the transport material in the region of the at least one hole, which assists the transport of liquid aerosol-forming substrate to the fluid permeable heating element in the region of the at least one hole.

The at least one hole may be formed in a central region of the transport material. Preferably, the at least one hole may be formed at the centre or centroid of the second surface of the transport material. When the transport material is inserted into the housing, the compression tends to be greatest towards the centre of the transport material. Therefore, locating the at least one hole in a central region of the transport material provides a formed fluid channel where it is needed most and assists in transporting liquid aerosol-generating substrate in the central region of the transport material.

The at least one hole may have an inlet diameter at the second surface of the transport material of between 0.5 mm and 2.5 mm, and more particularly between 0.8 mm and 2 mm, and yet more particularly of 1.3 mm. These sizes of hole have been found to be suitable for transporting liquid aerosol-forming substrate, which is drawn into the hole by wicking, i.e. capillary action. Furthermore, it has been found that this size of hole remains open, i.e. is not forced closed, when the transport material is inserted into the housing.

The at least one hole may taper towards the first surface of the transport material. It has been found that liquid absorption by wicking into converging channels is faster compared to cylindrical channels or diverging channels. Furthermore, the walls of the tapered hole do not necessarily have to be straight but may be curved. Curved walls, particularly those which curve inwardly, i.e. the walls are convex, have been found to further increase the speed with which liquid is absorbed because they increase the surface area of the walls of the channel with which the surface tension of the liquid interacts. The degree of curvature will depend on the properties of the liquid, particularly its surface tension.

The at least one hole may extend through the entire thickness of the transport material to provide a through-hole in the transport material. This arrangement provides a formed fluid channel all of the way through the transport material through which liquid aerosol-forming liquid may be transported.

The at least one hole may have an outlet diameter at the first surface of the transport material of between 0.2 mm and 0.4 mm, more particularly between 0.28 mm and 0.32 mm and yet more particularly of 0.3 mm. These ranges of outlet diameter have been found to be suitable sizes for transporting liquid aerosol-forming substrate to the fluid permeable heating element.

The first surface of the transport material may be convex, in particular a convex dome. This shape may be added to the first surface or may be a by-product of manufacturing the transport material with at least one hole, for example, by punching and piercing. As discussed above, the first surface of the transport material is arranged in fluid communication with the fluid permeable heating element such that the convex surface will be oriented towards the heating element. The heating element may have a residual bowed shape as a result of some manufacturing processes and therefore the convex first surface will better conform to the shape of the heating element. This may improve the transport of liquid aerosol-generating substrate to the heating element, particularly in arrangements in which the transport material is in contact with the fluid permeable heating element.

The transport material may comprise a disk. A disk has been found to be a particularly convenient shape as it is easy to manufacture by punching out and fits into tubular housings. However, it will be appreciated that the transport material can be formed in other suitable shapes such as a square, rectangle or oval or another curved or polygonal shape or an irregular shape. The thickness of the transport material may be less than the length or width or diameter of the transport material. The aspect ratio of the length or width or diameter of the transport material to the thickness of the transport material may be greater than 3:1.

The transport material may comprise a capillary material. A capillary material is a material that conveys liquid through the material by capillary action. The transport material may have a fibrous or porous structure. The transport material preferably comprises a bundle of capillaries. For example, the transport material may comprise a plurality of fibres or threads or other fine bore tubes. The transport material may be configured to primarily transport liquid in a direction orthogonal or normal to the thickness direction of the transport material.

The capillary material may preferably comprise elongate fibres such that capillary action occurs in the small spaces or micro-channels between the fibres. An average direction of the elongate fibres may be in a direction substantially parallel to the first and second surfaces and the at least one hole may extend in a direction substantially perpendicular to the average direction of the elongate fibres. This arrangement of elongate fibres means that capillary action primarily takes place substantially parallel to the first and second surfaces such that liquid aerosol-forming substrate is spread out across the transport material and fluid permeable heating element. Consequently, the transfer of liquid aerosol-forming substrate through the thickness of the transport material is relatively low. However, providing the at least one hole such that it extends in a direction substantially perpendicular to the average direction of the elongate fibres, means that a formed fluid channel extends at least partially through the thickness of the transport material and assists in conveying fluid through the thickness of the transport material to the fluid permeable heating element.

The transport material may comprise a heat resistant material having a thermal decomposition temperature of at least 160 degrees Celsius or higher such as approximately 250 degrees Celsius. The transport material may comprise fibres or threads of cotton or treated cotton, for example, acetylated cotton. Other suitable materials could also be used, for example, ceramic- or graphite based fibrous materials or materials made from spun, drawn or extruded fibres, such as fiberglass, cellulose acetate or any suitable heat resistant polymer. The fibres of the transport material may each have a thickness of between 10 μm and 40 μm and more particularly between 15 μm and 30 μm. The transport material may have any suitable capillarity and porosity so as to be used with different liquid physical properties. The liquid aerosol-forming substrate has physical properties, including but not limited to viscosity, surface tension, density, thermal conductivity, boiling point and vapour pressure, which allow the liquid aerosol-forming substrate to be transported through the transport material by capillary action.

The transport material may be provided with a plurality of holes. By providing more than one hole, additional formed fluid channels are created which may increase the transfer of liquid aerosol-generating substrate through the thickness of the transport material. The plurality of holes may be formed in and extend into the transport material from the second surface. Alternatively, a first hole may be formed in, and extend into the transport material from, the second surface and a second hole may be formed in, and extend into the transport material from, the first surface. The first and second holes may be connected so as to create a through-hole in the transport material. Alternatively, the first and second holes may be spaced apart in a direction parallel to the first and second surfaces such that the holes are not connected. However, fluid may be able to pass between the first and second holes via capillary action.

The heater assembly may further comprise a heater mount for mounting the transport material and the fluid permeable heating element. In addition, the heater assembly may further comprise a retention material to retain and convey liquid aerosol-generating substrate to the transport material. The retention material may also comprise a capillary material having a fibrous or porous structure which forms a plurality of small bores or micro-channels, through which the liquid aerosol-forming substrate can be transported by capillary action. The retention material may comprise a bundle of capillaries, for example, a plurality of fibres or threads or other fine bore tubes. The fibres or threads may be generally aligned to convey liquid aerosol-forming substrate towards the transport material. Alternatively, the retention material may comprise sponge-like or foam-like material. The retention material may comprise any suitable material or combination of materials. Examples of suitable materials are a sponge or foam material, ceramic- or graphite-based materials in the form of fibres or sintered powders, foamed metal or plastics material, a fibrous material, for example made of spun or extruded fibres, such as cellulose acetate, polyester, or bonded polyolefin, polyethylene, terylene or polypropylene fibres, nylon fibres or ceramic. The retention material may comprise high density polyethylene (HDPE) or polyethylene terephthalate (PET). The retention material may have a superior wicking performance compared to the transport material such that it retains more liquid per unit volume than the transport material. Furthermore, the transport material may have a higher thermal decomposition temperature than the retention material.

According to a second aspect of the present invention, there is provided a method of manufacturing a heater assembly for an aerosol-generating system, the method comprising: providing a fluid permeable heating element; providing a transport material, the transport material having a thickness defined between a first surface of the transport material and an opposing second surface of the transport material; forming at least one hole in the second surface of the transport material, wherein the at least one hole extends into the transport material to a depth corresponding to at least a part of the thickness of the transport material; arranging the first surface of the transport material in fluid communication with the fluid permeable heating element.

The transport material may be provided by cutting a disk from a section of transport material with a punch. Punching is a suitable manufacturing process which lends itself to mass manufacturing techniques. Furthermore, the punching action may help to impart a convex shape to the first surface of the transport material.

A cutting end of the punch may comprises a conical piercer for forming the at least one hole. A conical piercer has been found to be a suitable tool for forming the hole plus the conical shape may help to impart a tapered shape to the hole. However, the skilled person will appreciate that other shaped piercers could be used depending on the shape of hole required. Furthermore, other techniques can be used for forming the hole, for example, moulding, drilling, punching and laser drilling. By combining the punch and piercer, the step of forming the at least one hole can be carried out during the step of cutting the disk of transport material, which improves manufacturing efficiency.

The conical piercer may have a diameter at its widest part of between 0.5 and 2.5 mm, more particularly of between 0.8 and 2 mm and yet more particularly of 1.3 mm. This range of dimensions has been found to be a suitable diameter for forming the at least one hole.

According to a third aspect of the present invention, there is provided a cartridge for an aerosol-generating system, the cartridge comprising: the heater assembly of the first aspect described above; and a liquid storage compartment or portion for storing liquid aerosol-forming substrate.

The cartridge may further comprise a cap or retainer for retaining the components of the heater assembly and the liquid aerosol-generating substrate.

According to a fourth aspect of the present invention, there is provided an aerosol-generating system, comprising a main body part and the cartridge of the third aspect described above, wherein the cartridge is removably coupled to the main body part.

Features described in relation to one aspect may equally be applied to other aspects of the invention.

Embodiments of the invention will now be described, by way of example only, with reference to the accompanying drawings, in which.

Figure 1:
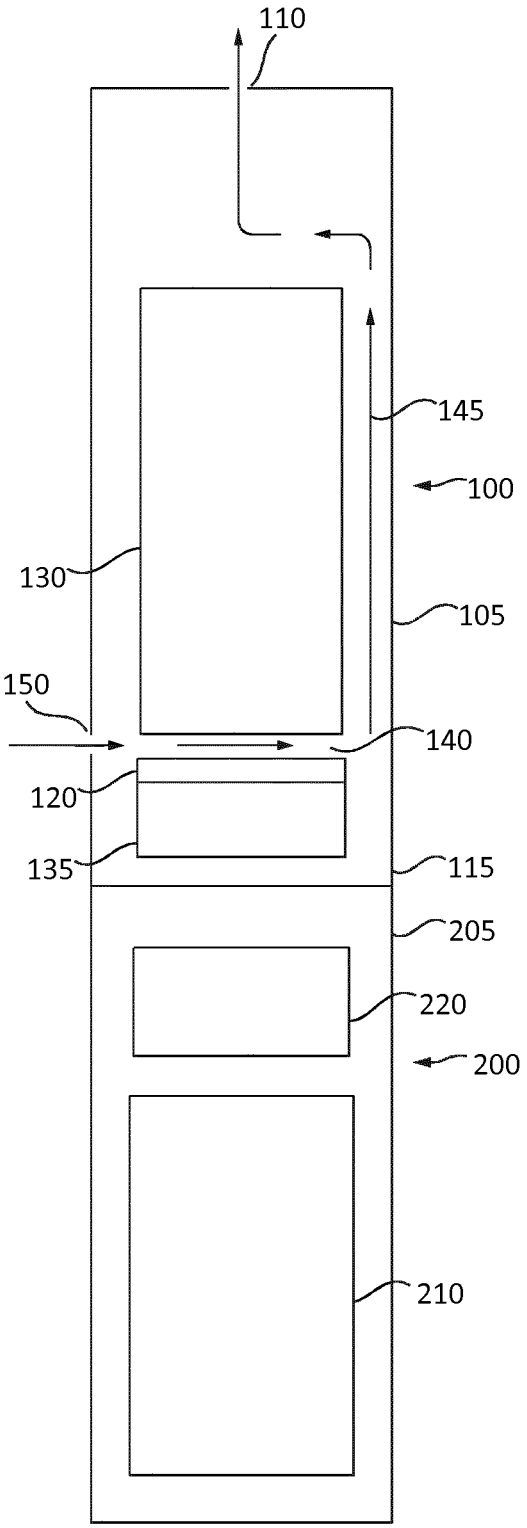
FIG. 1 is a schematic illustration of an aerosol-generating system in accordance with an embodiment of the invention.

FIG. 1 is a schematic illustration of an aerosol-generating system in accordance with an embodiment of the invention. The system comprises two main components, a cartridge 100 and a main body part 200. A connection end 115 of the cartridge 100 is removably connected to a corresponding connection end 205 of the main body part 200. The main body part 200 contains a battery 210, which in this example is a rechargeable lithium ion battery, and control circuitry 220. The aerosol-generating system is portable and has a size comparable to a conventional cigar or cigarette. A mouthpiece is arranged at the end of the cartridge 100 opposite the connection end 115.

The cartridge 100 comprises a housing 105 containing a heater assembly 120 and a liquid storage compartment having a first portion 130 and a second portion 135. A liquid aerosol-forming substrate is held in the liquid storage compartment. Although not illustrated in FIG. 1, the first portion 130 of the liquid storage compartment is connected to the second portion 135 of the liquid storage compartment so that liquid in the first portion 130 can pass to the second portion 135. The heater assembly 120 receives liquid from the second portion 135 of the liquid storage compartment. In this embodiment, the heater assembly 120 comprises a fluid permeable heating element.

An air flow passage 140, 145 extends through the cartridge 100 from an air inlet 150 formed in a side of the housing 105 past the heater assembly 120 and from the heater assembly 120 to a mouthpiece opening 110 formed in the housing 105 at an end of the cartridge 100 opposite to the connection end 115.

The components of the cartridge 100 are arranged so that the first portion 130 of the liquid storage compartment is between the heater assembly 120 and the mouthpiece opening 110, and the second portion 135 of the liquid storage compartment is positioned on an opposite side of the heater assembly 100 to the mouthpiece opening 110. In other words, the heater assembly 120 lies between the two portions 130, 135 of the liquid storage compartment and receives liquid from the second portion 135. The first portion 130 of liquid storage compartment is closer to the mouthpiece opening 110 than the second portion 135 of the liquid storage compartment. The air flow passage 140, 145 extends past the heater assembly 110 and between the first 130 and second 135 portion of the liquid storage compartment.

The system is configured so that a user can puff or draw on the mouthpiece opening 110 of the cartridge to draw aerosol into their mouth. In operation, when a user puffs on the mouthpiece opening 110, air is drawn through the airflow passage 140, 145 from the air inlet 150, past the heater assembly 120, to the mouthpiece opening 110. The control circuitry 220 controls the supply of electrical power from the battery 210 to the cartridge 100 when the system is activated. This in turn controls the amount and properties of the vapour produced by the heater assembly 120. The control circuitry 220 may include an airflow sensor (not shown) and the control circuitry 220 may supply electrical power to the heater assembly 120 when user puffs on the cartridge 100 are detected by the airflow sensor. This type of control arrangement is well established in aerosol-generating systems such as inhalers and e-cigarettes. So when a user puffs on the mouthpiece opening 110 of the cartridge 100, the heater assembly 120 is activated and generates a vapour that is entrained in the air flow passing through the air flow passage 140. The vapour cools within the airflow in passage 145 to form an aerosol, which is then drawn into the user's mouth through the mouthpiece opening 110.

In operation, the mouthpiece opening 110 is typically the highest point of the system. The construction of the cartridge 100, and in particular the arrangement of the heater assembly 120 between first and second portions 130, 135 of the liquid storage compartment, is advantageous because it exploits gravity to ensure that the liquid substrate is delivered to the heater assembly 120 even as the liquid storage compartment is becoming empty, but prevents an oversupply of liquid to the heater assembly 120 which might lead to leakage of liquid into the air flow passage 140.

Figure 2:
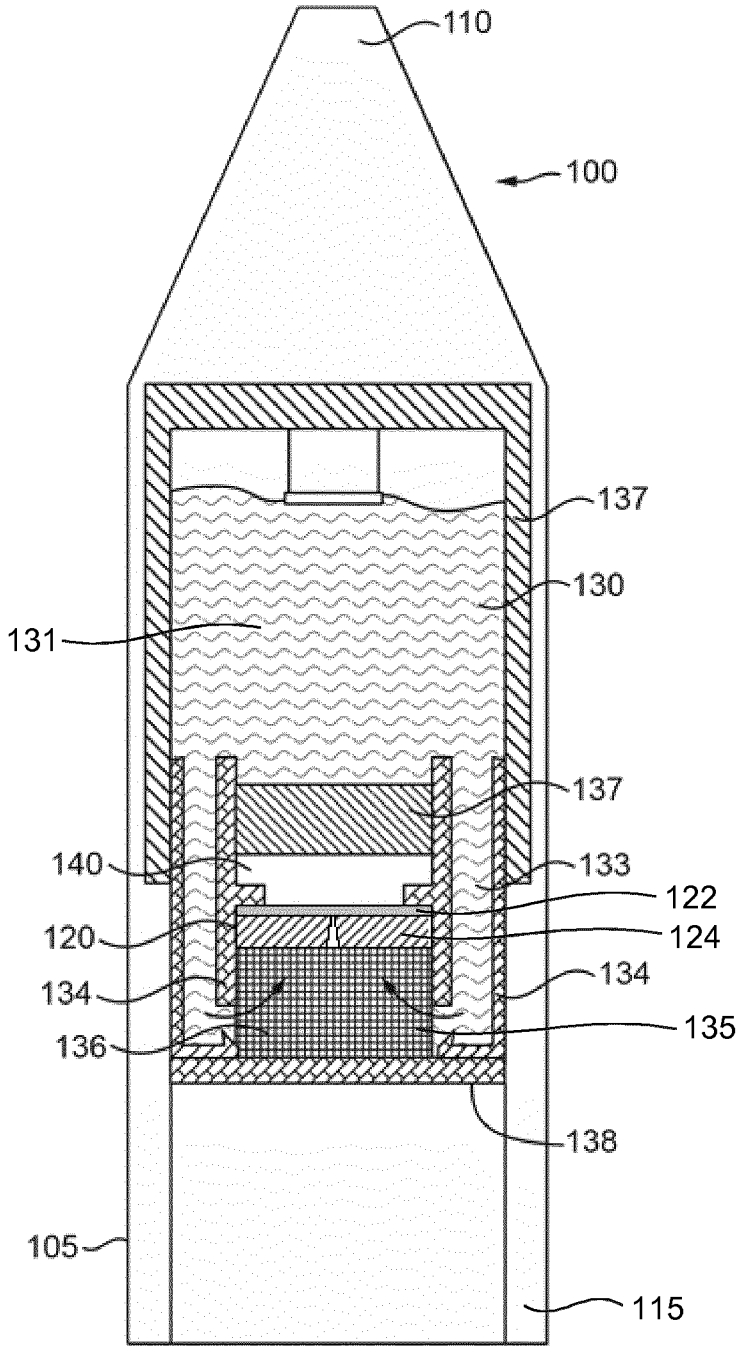
FIG. 2 is a schematic illustration of a cross-section of a cartridge, including a mouthpiece, in accordance with the invention.

FIG. 2 is a schematic cross section of a cartridge 100 in accordance with an embodiment of the invention. Cartridge 100 comprises an external housing 105 having a mouthpiece with a mouthpiece opening 110, and a connection end 115 opposite the mouthpiece. Within the housing 105 is a liquid storage compartment holding a liquid aerosol-forming substrate 131. The liquid storage compartment has a first portion 130 and a second portion 135 and liquid is contained in the liquid storage compartment by three further components, an upper storage compartment housing 137, a heater mount 134 and an end cap 138. A heater assembly 120 comprising a fluid permeable heating element 122 and a transport material 124 is held in the heater mount 134. A retention material 136 is provided in the second portion 135 of the liquid storage compartment and abuts the transport material 124 of the heater assembly 120. The retention material 136 is arranged to transport liquid to the transport material 124 of the heater assembly 120.

The first portion 130 of the liquid storage compartment is larger than the second portion 135 of the storage compartment and occupies a space between the heater assembly 120 and the mouthpiece opening 110 of the cartridge 100. Liquid in the first portion 130 of the storage compartment can travel to the second portion 135 of the liquid storage compartment through liquid channels 133 on either side of the heater assembly 120. Two channels are provided in this example to provide a symmetric structure, although only one channel is necessary. The channels are enclosed liquid flow paths defined between the upper storage compartment housing 137 and the heater mount 134.

The fluid permeable heating element 122 is generally planar and is arranged on a side of the heater assembly 120 facing the first portion 130 of the liquid storage compartment and the mouthpiece opening 110. The transport material 124 is arranged between the fluid permeable heating element 122 and the retention material 136. A first surface of the transport material 124 is in contact with the fluid permeable heating element 122 and a second surface of the transport material is in contact with the retention material 136 and the liquid 131 in the storage compartment. The second surface of the transport material 124 faces a connection end 115 of the cartridge 100. The heater assembly 120 is closer to the connection end 115 so that electrical connection of the heater assembly 120 to a power supply can be easily and robustly achieved.

An airflow passage 140 extends between the first and second portions of the storage compartment. A bottom wall of the airflow passage 140 comprises the fluid permeable heating element 122. Side walls of the airflow passage 140 comprise portions of the heater mount 134, and a top wall of the airflow passage comprises a surface of the upper storage compartment housing 137. The air flow passage has a vertical portion (not shown) that extends through the first portion 130 of the liquid storage compartment towards the mouthpiece opening 110.

It will be appreciated that the arrangement of FIG. 2 is only one example of a cartridge for an aerosol-generating system. Other arrangements are possible. For example, the fluid permeable heating element, transport material and retention material could be arranged at one end of a cartridge housing, with a liquid storage compartment being arranged at the other.

Figure 3:
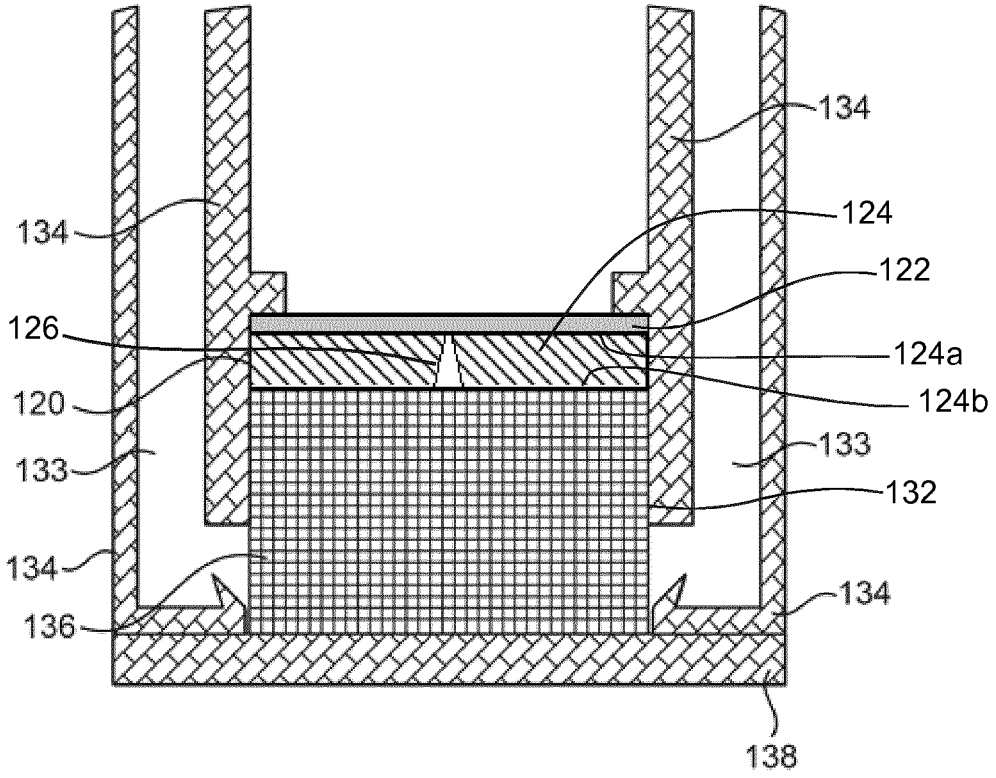
FIG. 3 illustrates the heater mount of FIG. 2.

FIG. 3 is a cross-sectional illustration of the heater mount 134 of FIG. 2 showing its features in more detail. The transport material 124 and part of the retention material 136 are located within a tubular recess 132 formed in the heater mount 134. The fluid permeable heating element 122 extends across the tubular recess 132. A first surface 124*a* of the transport material 124 is in contact with the underside of the fluid permeable heating element 122 so as to provide fluid communication between the transport material 124 and the heating element 122 for liquid aerosol-generating substrate. A first portion of the retention material 136 is located within tubular recess 132 and abuts a second surface 124*b* of the transport material 124 such that the transport material 124 can receive liquid aerosol-generating substrate from the retention material 136. A second portion of the retention material 136 extends outside the tubular recess 132 and is in fluid communication with the liquid channels 133 such that the second portion of the retention material 136 can receive liquid aerosol-generating liquid from the liquid channels 133. The second portion of the retention material 136 abuts an end cap 138 which seals the lower end of the heater mount 134. The heater mount 134 is injection moulded and formed from an engineering polymer, such as polyetheretherketone (PEEK) or LCP (liquid crystal polymer).

The fluid permeable heating element 122 comprises a planar mesh heater element, formed from a plurality of filaments. Details of this type of heater element construction can be found in published PCT patent application no. WO2015/117702. The heating element extends outside the tubular recess 132 in a direction into and out of the plane of FIG. 2 such that opposing ends of the heating element are located on the outside the heater mount 134. Contact pads are provided at each of the opposing ends of the heating element 122 to supply electrical power to the heating element 122.

Both the transport material 124 and the retention material 136 are formed from capillary materials which retain and convey liquid aerosol-forming substrate. As described above, the transport material 124 is in direct contact with the heating element 122 and has a higher thermal decomposition temperature (at least 160 degree Celsius or higher such as approximately 250 degree Celsius) than the retention material 136. The transport material 124 effectively acts as a spacer separating the heating element 122 from the retention material 136 so that the retention material 136 is not exposed to temperatures above its thermal decomposition temperature. The thermal gradient across the transport material 124 is such that the retention material 136 is only exposed to temperatures below its thermal decomposition temperature. The retention material 136 may be chosen to have superior wicking performance to the transport material 124 such that it retains more liquid per unit volume than the transport material 124. In this example the transport material 124 is a heat resistant material, such as a cotton or treated cotton containing material and the retention material 136 is a polymer such as high density polyethylene (HDPE) or polyethylene terephthalate (PET).

The transport material 124 is formed as a disk having a diameter of approximately 5.8 mm and a thickness of approximately 2.5 mm. This diameter is slightly larger than the internal diameter of the tubular recess 132 such that the transport material 124 is compressed radially inwards towards the centre of the disk when the transport material 124 is inserted into the tubular recess 132. This is done to provide a seal between the outer circumference of the disk and the internal circumference of the tubular recess 132 to inhibit the leakage of liquid aerosol-generating substrate around the outside of the transport material 124. However, compressing the disk compresses the micro-channels of the capillary material from which the transport material 124 is made. This can be problematic because it can inhibit the transport of liquid aerosol-forming substrate through the transport material 124.

To seek to alleviate this problem, the second surface 124*b* of the transport material 124 is provided with a hole 126 which extends through the entire thickness of the transport material 124, i.e. from the second surface 124*b* to the first surface 124*a*. The hole 126 is provided at the centre of the transport material 124, where the compression is greatest, and defines a formed fluid channel for liquid aerosol-generating substrate. This assists liquid to pass through the central region of the transport material 124 where the compression is greatest. The holes tapers towards the first surface 124*a* of the transport material 124 and can have various different sizes depending on the characteristics of the transport material 124 and the liquid aerosol-generating substrate. In this example, the hole 126 has an inlet diameter at the second surface 124*b* of 1.3 mm and an outlet diameter at the first surface 124*a* of 0.3 mm before it is compressed into the tubular recess 132. The hole 126 is provided by piercing the transport material 124 with a conical piercing tool, which is described below.

Figure 4:
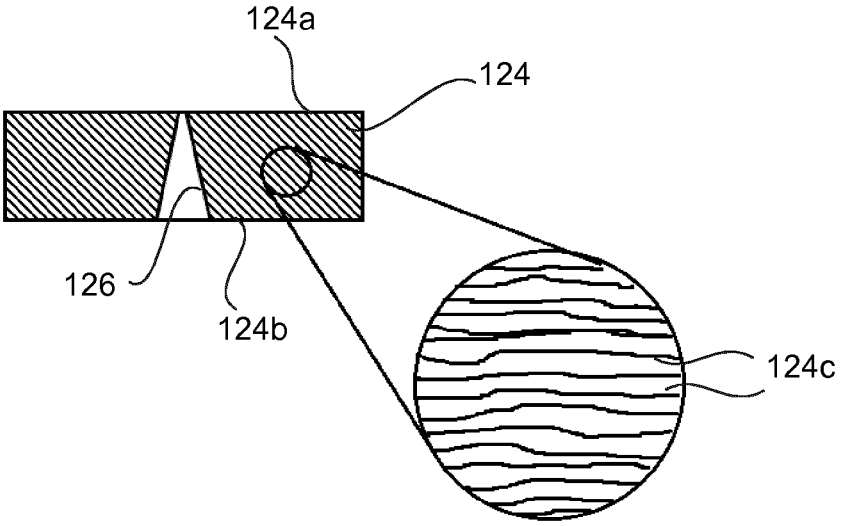
FIG. 4 is a cross-sectional illustration of the transport material of FIGS. 2 and 3 showing an enlarged area of its internal structure.

FIG. 4 shows a cross-sectional view of the transport material 124 of FIGS. 2 and 3. A cross-sectional area of the transport material 124 has been enlarged one hundred times to show its internal structure. The transport material 124 is formed of elongate fibres which are aligned substantially parallel to the first 124*a* and second 124*b* surfaces of the transport material 124. Liquid is conveyed through the transport material 124 in the small spaces or micro-channels between the elongate fibres 124*c* by capillary action. Although some liquid is transported through the thickness of the transport material 124, the predominant direction of liquid transport is along the fibres, i.e. substantially parallel to the first 124*a* and second 124*b* surfaces of the transport material 124. This arrangement prevents too much liquid being transported to the fluid permeable heating element, which may result in leaks and drops of liquid aerosol-forming substrate being deposited in the airflow passage. Furthermore, it helps to spread out the liquid aerosol-forming substrate over the area of the fluid permeable heating element to assist in uniform wetting of the heating element. However, due to the compression of the transport material 124 described above the micro-channels at the centre of the transport material 124 can be constricted which inhibits the transport of liquid aerosol-generating substrate through the transport material 124, i.e. from the retention material to the fluid permeable heating element. The hole 126 seeks to overcome this problem by providing a formed fluid channel in the central region of the transport material to allow sufficient liquid aerosol-generating substrate to reach the fluid permeable heating element in order to avoid a dry puff situation. The hole 126 extends in a direction substantially perpendicular to the average direction of the elongate fibres 124*c*.

Figure 5:
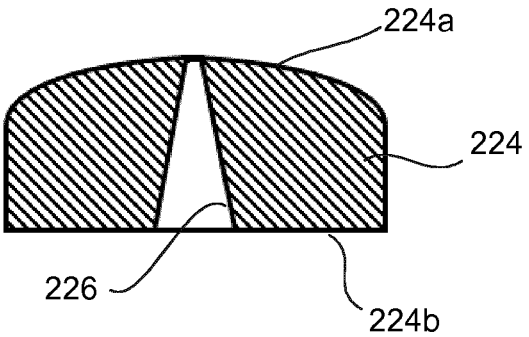
FIGS. 5 to 8 are cross-sectional illustrations of a transport materials in accordance with various embodiments of the invention.

FIG. 5 shows a transport material 224 according to another embodiment of the invention. The transport material 224 is similar to that shown in FIG. 4 with the exception that it has a convex first surface 224*a*, in particular a convex dome shape. This shape may result from the punching and piercing process used to manufacture the transport material 224 which is applied to the second surface 224*b* and tends to cause the first surface 224*a* to bow outwards due to the application of the punching and piercing force. Alternatively, it can be added to the transport material 224, for example, by forcing it into a mould. This arrangement helps the transport material 224 conform to the shape of a curved fluid permeable heating element, which shape may be a by-product of some manufacturing processes used to make the fluid permeable heating element. A tapered hole 226 passes through the entire thickness of the transport material 224. The transport material is formed as a disk having a diameter of approximately 5.8 mm and a thickness of approximately 2.5 mm at its thickest point.

Figure 6:
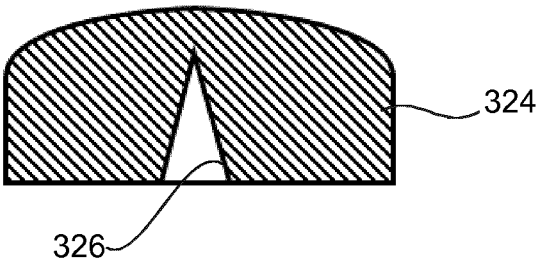

FIG. 6 shows a transport material 324 according to another embodiment of the invention. The transport material 324 is similar to that shown in FIG. 5 with the exception that the hole 326 extends only partially through the thickness of the transport material 324. In this example, the hole 326 extends into the transport material 324 to a depth greater than half of the thickness of the transport material 324. Although this arrangement does not provide a through-hole in the transport material 324 for liquid to flow through, it still increases the flow of liquid aerosol-generating substrate through the transport material by reducing the thickness of the transport material in the region of the hole in which the liquid has to flow through; in this example, to less than half of the thickness. In other words, liquid that flows into the hole 326 is able to permeate more easily through the remainder of the thickness of the transport material 324 compared to having to permeate through the entire thickness.

Figure 7:
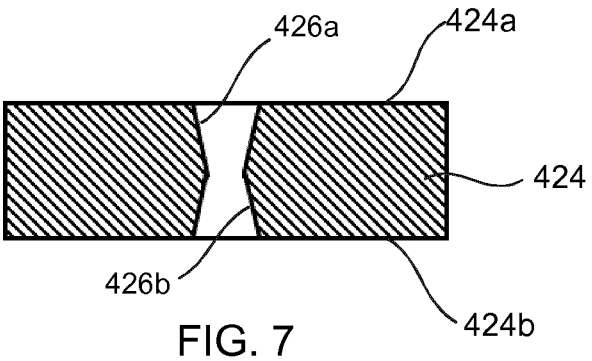

FIG. 7 shows a transport material 424 according to another embodiment of the invention. Again, the transport material 424 is formed as a disk having a diameter of approximately 5.8 mm and a thickness of approximately 2.5 mm. The transport material 424 comprises a plurality of holes; a first hole 426*a* provided in the first surface 424*a* and a second hole 426*b* provided in the second surface 424*b*. Each of the first 426*a* and second 426*b* holes extends into the transport material 424 to a depth greater than half of the thickness of the transport material 424. The first 426*a* and second 426*b* holes are aligned so that they connect to form a through-hole in the transport material 424 through which liquid aerosol-generating substrate can pass.

Figure 8:
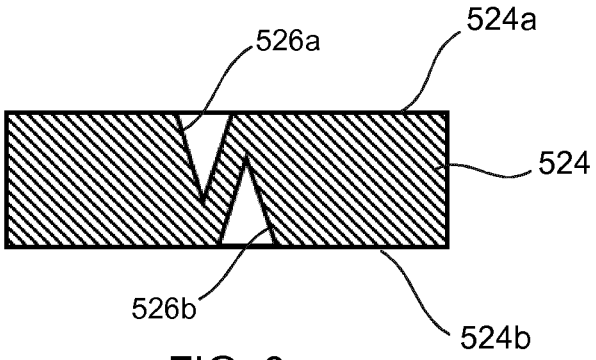

FIG. 8 shows a transport material 524 according to another embodiment of the invention. The transport material 524 is similar to that shown in FIG. 7 with the exception that the first 526*a* and second 526*b* holes are not aligned but are spaced apart in a direction parallel to the first 524*a* and second 524*b* surfaces. Each of the first 526*a* and second 526*b* holes extends into the transport material 524 to a depth greater than half of the thickness of the transport material 524. Liquid aerosol-generating substrate which flows into hole 526*b* can travel via capillary action along the elongate fibres of the transport material 524 in a direction parallel to the first 524*a* and second 524*b* surfaces into hole 526*a* where it can pass to the fluid permeable heating element.

A method of manufacturing a heater assembly according to an embodiment of the invention comprises arranging a transport material in fluid communication with a fluid permeable heating element. One example of achieving fluid communication is to arrange the transport material in contact with the fluid permeable heating element. The transport material can be provided by punching a disk from a larger piece of transport material.

Figure 9:
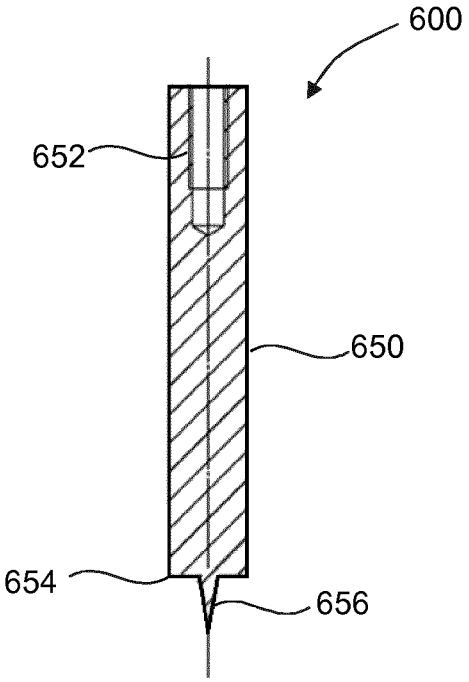
FIG. 9 is a cross-sectional illustration of a punch tool used to manufacture a transport material in accordance with an embodiment of the invention.

FIG. 9 shows an example of a punch 600 for providing the disk of transport material. The punch 600 comprises a cylindrical column 650 having an internal thread 652 at one end for attaching the punch to a press (not shown). The longitudinal thread 652 extends longitudinally into the cylindrical column 650. The other end of the cylindrical column 650 comprises a cutting end 654 of the punch 600 which is configured to cut the disk of transport material. The cutting end has the same diameter as the disk of transport material, i.e. approximately 5.8 mm. A conical piercer 656 is located at the cutting end which is configured to pierce the transport material to form a hole. The conical piercer 656 has a diameter at its widest part of approximately 1.3 mm and is approximately 4.3 mm long. By placing the conical piercer 656 at the cutting end of the punch 600, it is possible to pierce the transport material during the step of cutting the disk of transport material.

The invention claimed is:

1. A heater assembly for an aerosol-generating system, the heater assembly comprising:

a fluid-permeable heating element configured to vaporise a liquid aerosol-forming substrate; and a transport material configured to transport the liquid aerosol-forming substrate to the fluid-permeable heating element, the transport material having a thickness defined between a first surface of the transport material and an opposing second surface of the transport material, wherein the first surface of the transport material is arranged in fluid communication with the fluid-permeable heating element and the second surface of the transport material is arranged to receive the liquid aerosol-forming substrate, wherein the second surface of the transport material is provided with at least one hole, which extends into the transport material to a depth corresponding to at least a part of the thickness of the transport material to define a formed fluid channel for the liquid aerosol-forming substrate, wherein the transport material comprises a capillary material having elongate fibres, wherein an average direction of the elongate fibres is in a direction substantially parallel to the first and the second surfaces of the transport material, and wherein the at least one hole extends in a direction substantially perpendicular to the average direction of the elongate fibres.

2. The heater assembly according to claim 1, wherein the depth of the at least one hole is more than half of the thickness of the transport material.

3. The heater assembly according to claim 1, wherein the at least one hole is formed at a centre of the second surface.

4. The heater assembly according to claim 1, wherein the at least one hole has an inlet diameter at the second surface of the transport material of between 0.5 mm and 2.5 mm.

5. The heater assembly according to claim 1, wherein the at least one hole has an inlet diameter at the second surface of the transport material of 1.3 mm.

6. The heater assembly according to claim 1, wherein the at least one hole tapers towards the first surface of the transport material.

7. The heater assembly according to claim 1, wherein the at least one hole extends through an entire thickness of the transport material to provide a through-hole in the transport material.

8. The heater assembly according to claim 6, wherein the at least one hole has an outlet diameter at the first surface of the transport material of between 0.2 mm and 0.4 mm.

9. The heater assembly according to claim 6, wherein the at least one hole has an outlet diameter at the first surface of the transport material of 0.3 mm.

10. The heater assembly according to claim 1, wherein the first surface of the transport material is convex.

11. The heater assembly according to claim 1, wherein the transport material comprises a disk.

12. The heater assembly according to claim 1, wherein the transport material is provided with a plurality of holes.

13. A method of manufacturing a heater assembly for an aerosol-generating system, the method comprising:

providing a fluid-permeable heating element;

providing a transport material, the transport material having a thickness defined between a first surface of the transport material and an opposing second surface of the transport material, wherein the transport material comprises a capillary material having elongate fibres, and wherein an average direction of the elongate fibres is in a direction substantially parallel to the first and the second surfaces;

forming at least one hole in the second surface of the transport material, wherein the at least one hole extends into the transport material to a depth corresponding to at least a part of the thickness of the transport material, wherein the at least one hole extends in a direction substantially perpendicular to the average direction of the elongate fibres; and arranging the first surface of the transport material in fluid communication with the fluid-permeable heating element.

14. The method according to claim 13, wherein the transport material is provided by cutting a disk from a section of the transport material with a punch.

15. The method according to claim 14, wherein a cutting end of the punch comprises a conical piercer for forming the at least one hole such that the step of forming the at least one hole is carried out during the step of cutting the disk of the transport material.

16. The method according to claim 15, wherein the conical piercer has a diameter at a widest part thereof of between 0.5 mm and 2.5 mm.

17. The method according to claim 15, wherein the conical piercer has a diameter at a widest part thereof of 1.3 mm.

18. A cartridge for an aerosol-generating system, the cartridge comprising:

the heater assembly according to claim 1; and a liquid storage portion configured to store a liquid aerosol-forming substrate.

19. An aerosol-generating system, comprising:

a main body part; and the cartridge according to claim 18, wherein the cartridge is removably coupled to the main body part.

* * * * *